United States Patent [19]

Buhrer

[11] Patent Number: 4,466,348

[45] Date of Patent: Aug. 21, 1984

[54] OFFSET INTAGLIO PRINTER HAVING A SPREADER WITH A LATERALLY EXTENDING SLOT

[75] Inventor: Rudolf Buhrer, Opfertshofen, Switzerland

[73] Assignee: Teca-Print AG., Thayngen, Switzerland

[21] Appl. No.: 463,655

[22] Filed: Feb. 3, 1983

[30] Foreign Application Priority Data

Feb. 12, 1982 [CH] Switzerland ..... 908/82

[51] Int. Cl.[3] ..... B41F 17/00; B41F 31/00

[52] U.S. Cl. ..... 101/163; 101/41; 101/167; 101/169

[58] Field of Search ..... 101/41, 163, 167, 169; 118/263, 261, 256

[56] References Cited

U.S. PATENT DOCUMENTS 4,060,031 11/1977 Philipp ..... 101/163

FOREIGN PATENT DOCUMENTS 546644 1/1974 Switzerland .

911534 11/1962 United Kingdom ..... 101/163

*Primary Examiner*—Clifford D. Crowder

*Attorney, Agent, or Firm*—Bernard, Rothwell & Brown

[57] ABSTRACT

The swab printing machine is provided with an inking device having a carriage. A spreader support with a spreader head is tippably arranged on the frontal side of the carriage and can reciprocate over a printing plate. The spreader which is inclined backward by about 20°, takes ink from the ink container during its forward motion and distributes it over the printing plate, whereby the two rounded slide feet achieve the uniform distribution of the ink. During the return motion the excess ink is wiped off by a doctor blade. A laterally running recess is arranged in the lower portion of the spreader and the lower edge of this recess forms a narrow dipping edge. An adjustable central closure is provided on the spreader support and on the spreader head. After the initial positioning of the spreader head it is possible to remove same, clean it and remount it, without making readjustments. Because of the narrow dipping edge, the same quantity of ink is always transported onto the printing plate, regardless of the immersion depth of the spreader.

6 Claims, 7 Drawing Figures

OFFSET INTAGLIO PRINTER HAVING A SPREADER WITH A LATERALLY EXTENDING SLOT

BACKGROUND OF THE INVENTION

1. Field of the Invention

This invention relates to improvements in swab printing machines.

2. Prior Art

By means of the swab printing process, smooth and uneven surfaces of objects can be printed on in a simple manner. After the inking of the printing plate and removal of the excess ink, the printing pillow, also known as a swab, is pressed onto the printing plate, raised therefrom and then pressed against the object to be printed on, in order to transfer the printed image.

A swab printing machine of this type is known in Swiss Pat. No. 546,644. A spreader guide body is attached to the spreader support of this machine, which spreader guide body includes an opening in which the spreader is slidably mounted. A slot is provided in the center of the spreader, in which slot a guide pin engages in order thereby to limit the level of the spreader between two end positions.

The spreader, which is made of sheet steel, is drawn downward by its own weight. In the lower end position the lower edge of the spreader dips a few millimeters deep into the ink container. The dipping depth is determined so that an optimal quantity of ink is transported onto the printing plate.

Too deep of an immersion would have disadvantageous results. On the one hand, too much ink would be pushed onto the printing plate and on the other hand, ink would be sprayed backward during each return and immersion into the ink container.

In order to maintain the optimal dipping depth at a more or less constant level, the ink container must be refilled often. Furthermore, no mixing of the ink takes place, because the spreader always penetrates only into the surface region of the ink, leaving the lower ink regions in the container unmoved.

A further disadvantage of the known machine is that after cleaning of the spreader and the spreader support, the precise position on the carriage must be reestablished and fixed, which must be done extremely carefully and precisely and is therefore expensive in terms of time.

SUMMARY OF THE INVENTION

The invention therefore has as its object the creation of a swab printing machine in which the above-mentioned disadvantages are avoided. Independent of the fill level of the ink container, it should be possible to always transport the same quantity of ink onto the printing plate. The ink in the ink container should periodically be well mixed. Furthermore, it should be possible to simply remove the doctor, spreader and spreader support for cleaning purposes and remount them without adjustment.

This object is achieved according to the invention by means of the swab printing machine having an inking device and a carriage, on the frontal side of which is arranged a spreader support with a spreader head, which spreader support is tippable and can reciprocate over a printing plate, whereby the rearwardly inclined spreader, which is loosely guided in the spreader head and is drawn downward by its own weight, takes ink from an ink container during its forward motion and distributes it over the printing plate, and whereby during the return, a doctor blade located in the spreader head wipes off the excess ink, with improvements characterized by and comprising: at least one laterally running recess arranged in the lower portion of the spreader, the lower edge of which forms a narrow dipping edge, and adjustable positioning means provided on the spreader support and on the spreader head.

DETAILED DESCRIPTION OF THE PREFERRED EMBODIMENT

Figure 1:
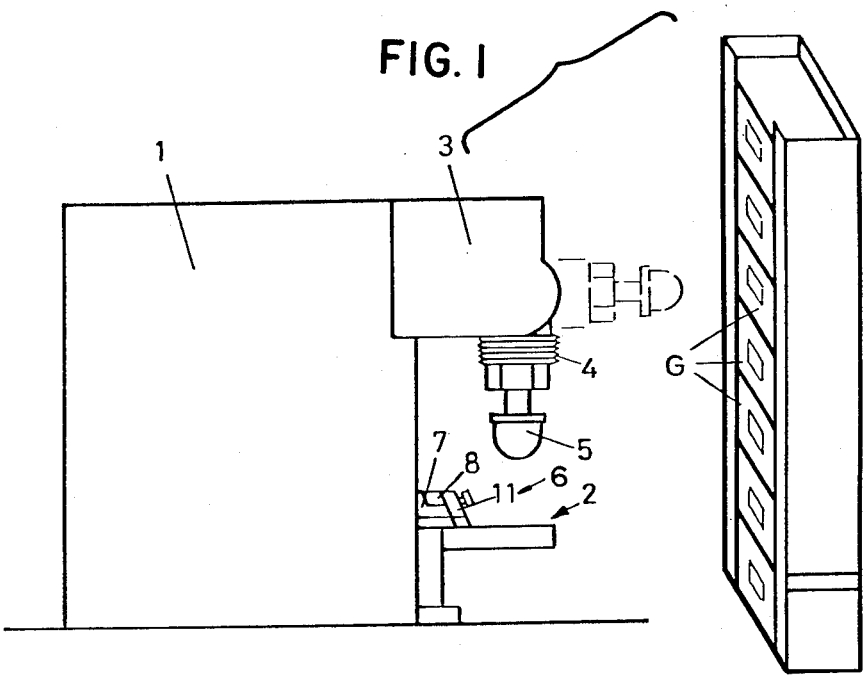
FIG. 1 is a side view of a swab printing machine, whereby a stack of objects to be printed on is shown in perspective.
Figure 4:
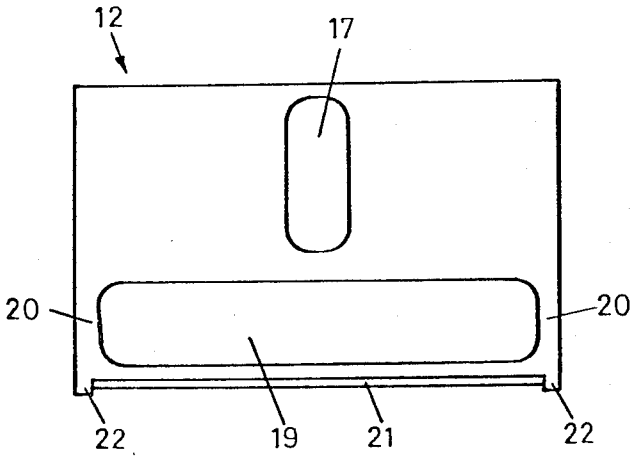
FIG. 4 is a top view of the spreader.
Figure 5:
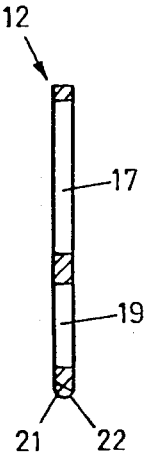
FIG. 5 is a cross section through the spreader.

The swab printing machine illustrated in FIG. 1 includes a machine stand 1, which on its frontal side is provided with a table for the inking device and printing plate holder 2. Above this holder 2, a machine element 3 is arranged on which the printing device 4 with the swab 5 is attached. The swab 5 consists, for example, of silicone rubber or another elastic material.

An inking device 6 includes an inking slot 7', on which a spreader support 8 is tippably mounted. The printing plate 9 is mounted on the holder 2. The printed material to be transferred is photographically applied to the printing plate and etched. After the inking the etched locations of the printing plate are filled with ink. The swab 5 is then pneumatically lowered onto the plate; then after a predetermined stroke, it is again raised and pivoted. It is then pressed onto an object G to be printed on.

Figure 6:
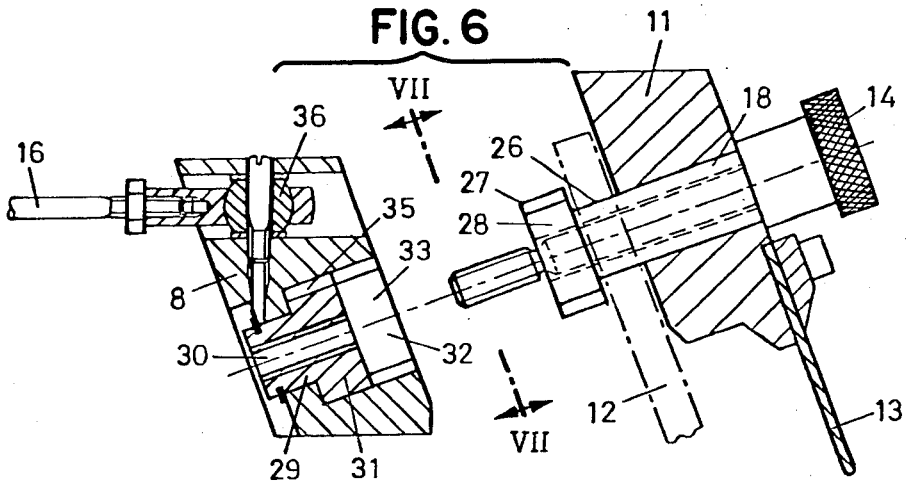
FIG. 6 is an exploded view of the spreader support, partially in section.
Figure 6:
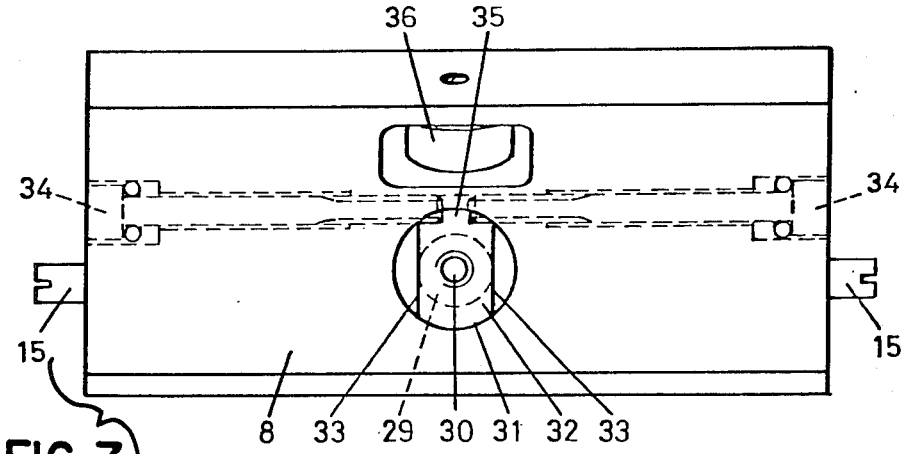
Figure 7:
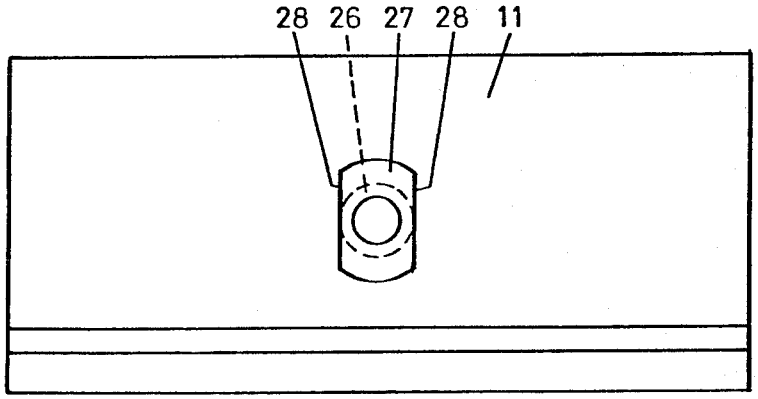
FIG. 7 shows frontal views of the spreader support and the spreader head according to the arrow VII in FIG. 6.

The spreader support 8 is attached to two lateral arms 10 of the reciprocatingly guided carriage 7. A spreader head 11, on which both the spreader 12 and a doctor blade 13 are arranged, is mounted on the spreader support 8 by means of a knurled head screw 14. The spreader support 8 is mounted so as to be tippable about the axis 15, whereby the tipping movement is caused by a bar 16 (FIG. 6) which can reciprocate relative to the carriage 7. The bar 16 is articulatably connected with the upper portion of the spreader support 8 and is driven by suitable control means which are not shown in further detail.

The spreader 12 is slightly inclined out of the vertical (for example about 20°). It is formed rectangularly and includes a vertical slot 17, in which a pin 18 of the spreader head 11 loosely engages. By this means the lateral guiding of the spreader 12 on the printing plate is achieved.

The spreader also includes a laterally extending slot 19, which is arranged beneath the vertical slot 17. The slot 19 is bounded laterally by the two narrow vertical wall portions 20 and at the bottom by the narrow dipping edge 21, and has at the sides respective rounded slide feet 22.

Figure 2:
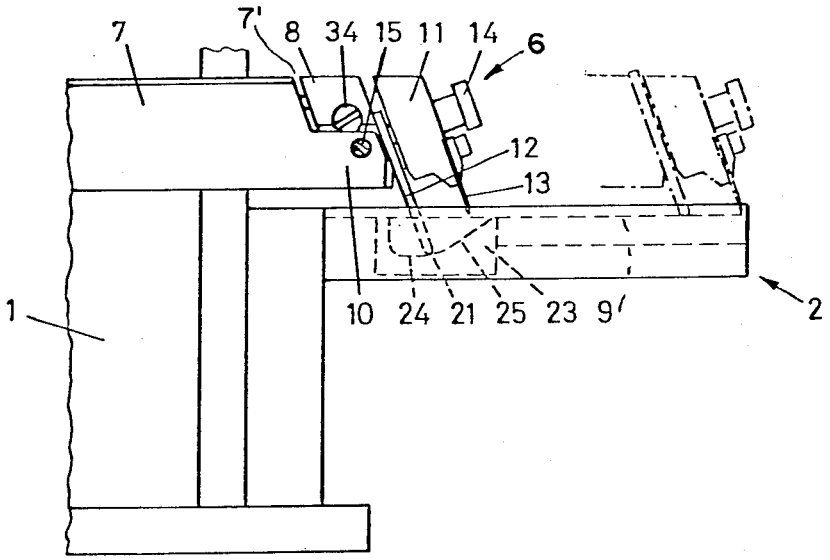
FIG. 2 is an enlarged side view of the inking device of the swab printing machine according to FIG. 1.
Figure 3:
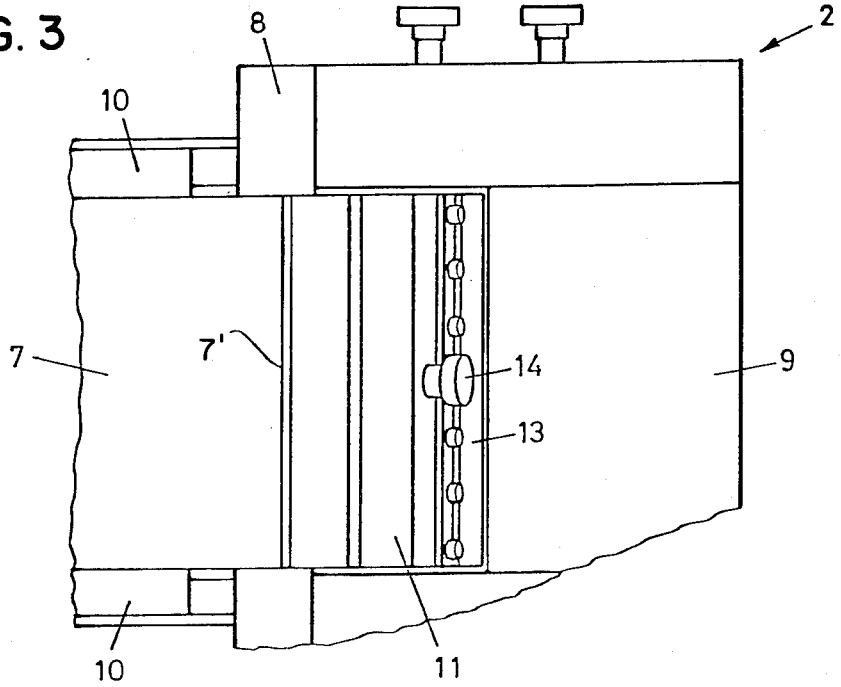
FIG. 3 is a top view of the inking device according to FIG. 2.

As shown in FIG. 2, the stroke limits of the spreader 12 are selected such that the dipping edge 21 contacts the floor 24 of the ink container 23. The ink container 23 includes an inclined surface 25, which extends upward form the floor 24 toward the printing plate.

During the forward motion of the carriage 7 the spreader support 8 is tipped upward, so that the doctor 13 does not contact the printing plate. The spreader 12 slides along the inclined surface 25 of the ink container 23 and pushes a layer of ink onto the printing plate 9. As a result of the recess 19 and the narrow dipping edge 21, the same quantity of ink is always removed from the container, regardless of the depth of immersion. Because the dipping edge 21 projects down to the floor of the container 23, the ink is well mixed during each immersion.

After the coating of the plate 9 with ink the spreader support 8 is tipped downward, so that the flexible and rearwardly inclined doctor blade 13 contacts the printing plate 9. During the backward motion of the carriage 7 the excess ink is wiped back from the printing plate 9 into the ink container by the blade of the doctor 13.

During the backward motion the spreader slides on the surface of the ink in the container 22, without dipping immediately into the ink. This behavior is explained by the low specific gravity and by the relatively flat angle of about 15° on the dipping edge 21, which produces the floating effect during the backward motion. Accordingly, the spreader does not sink down through the ink to the floor 24 of the container until it stops in its end position. This movement avoids a splashing of the ink over the container walls.

In order to be able to easily remove the spreader support 8 with the spreader head 11 and the spreader 12 for cleaning purposes and subsequently remount them without having to make adjustments, the following has been selected as a constructive design, acting as a central closure: The pin 18, which is provided with a bore for the screw 14, projects into the spreader head 11 with a press fitting. Its projecting portion consists of an inner section 26 having a round cross section and an expanded outer section 27 having two parallel side surfaces 28, the spacing of which corresponds to the diameter of the round section 26, so that the spreader can be pushed into place without problem. The parallel surfaces 28 run perpendicularly to the lower edge of the spreader head 11.

An insert 29 with a threaded bore 30 for the screw 14 is located in the spreader support 8. The portion of the insert 29 facing the spreader head 11 is provided with an expanded section 31 in which a recess 32 is arranged, also having two parallel side surfaces 33.

Adjusting screws 34 are provided at the sides of the spreader support, which screws act on a stop 35 arranged eccentrically to the axis of the insert 29. The insert can be rotated and fixed in the spreader support by means of the screws 34.

As the spreader head 11 is placed in the spreader support 8, the pin section 27 projects into the recess 32, whereby the opposing position is determined by the parallel surfaces. By means of the screws 34 the position of the spreader head is then precisely adjusted, so that the blade edge 13 is directed exactly parallel to the surface of the printing plate.

The spreader 12 itself does not have to be adjusted, since it is held loosely by the inner pin section 26 and adapts itself to the surface of the printing plate. In each succeeding removal and remounting of the spreader head, a new adjustment is no longer necessary, since the two parallel surfaces of the pin section 27 and the recess 32 assure a precise positioning.

An articulated connection 36 for the end of the bar 16 is arranged above the insert 29.

If a spreader is quite wide, several adjacent lateral slots 19 can be provided, in order to assure the stability of the spreader. With such a spreader it is also possible to perform multiple color prints, whereby in such a case the number of ink containers provided corresponds to the number of lateral slots.

I claim:

1. Swab printing machine having an inking device, an ink container and a carriage, the carriage including on its frontal side a spreader support, which spreader support is tippable and can reciprocate over a printing plate, a spreader having lower and upper parts wherein the spreader is upwardly and rearwardly inclined from said lower part to said upper part, and a spreader head including a doctor blade, the spreader being loosely guided in the spreader head and drawn downward by its own weight thereby taking ink from the ink container during its forward motion and distributing it over the printing plate, and whereby during the return, the doctor blade in the spreader head wipes off the excess ink, with improvements characterized by and comprising: at least one laterally extending slot through the lower part of the spreader, the lower edge of the spreader forming a narrow dipping edge, and adjustable spreader head positioning means provided on the spreader support and on the spreader head.

2. Machine according to claim 1, further comprising means for guidance of the spreader, including a vertical slot in which a pin engages, whereby the stroke length is selected such that the dipping edge contacts a floor of an ink container, and that said ink container includes an inclined surface which extends upwardly from the floor toward the printing plate, over which inclined surface the dipping edge slides during the forward motion of the spreader head.

3. Machine according to claim 1, wherein the adjustable positioning means additionally provide means for detachably securing the spreader head to the spreader support, the adjustable positioning means including a projecting pin section anchored in the spreader head and an insert containing a recess, such that the pin section fits into the recess, and the pin section and recess are provided with matching opposing positioning surfaces.

4. Machine according to claim 3, wherein the pin section is provided with two parallel positioning surfaces running perpendicular to the blade edge of the doctor and that the recess includes two corresponding parallel surfaces.

5. Machine according to claim 3, wherein the insert is rotatably mounted in the spreader support, and further comprising two lateral adjusting screws, positioned to act on the insert in order to rotate it and fix it in the desired position.

6. Machine according to claim 1, wherein the spreader is made of a lightweight metal and is anodized.

* * * * *